US009077091B2

(12) United States Patent
Laurent

(10) Patent No.: US 9,077,091 B2
(45) Date of Patent: Jul. 7, 2015

(54) RECEPTACLE WITH TERMINAL HOLD-OPEN DETENT

(71) Applicant: Maxim Laurent, Brooklyn, NY (US)

(72) Inventor: Maxim Laurent, Brooklyn, NY (US)

(73) Assignee: LEVITON MANUFACTURING CO., INC., Melville, NY (US)

( * ) Notice: Subject to any disclaimer, the term of this patent is extended or adjusted under 35 U.S.C. 154(b) by 87 days.

(21) Appl. No.: 14/033,745

(22) Filed: Sep. 23, 2013

(65) Prior Publication Data

US 2015/0087191 A1 Mar. 26, 2015

(51) Int. Cl.
*H01R 4/44* (2006.01)
*H01R 4/40* (2006.01)

(52) U.S. Cl.
CPC ..... *H01R 4/40* (2013.01)

(58) Field of Classification Search
CPC ..... H01R 4/30; H01R 4/34; H01R 4/38; H01R 4/301–4/305; H01R 25/006
USPC ..... 439/782, 739, 107, 806; 174/53, 60
See application file for complete search history.

(56) References Cited

U.S. PATENT DOCUMENTS

| | | | | |
|---|---|---|---|---|
| 2,249,471 | A | | 7/1941 | Hamm et al. |
| 3,793,607 | A | | 2/1974 | Smith et al. |
| 4,146,289 | A | | 3/1979 | Kirrish |
| 4,174,148 | A | | 11/1979 | Obuch et al. |
| 4,634,211 | A | | 1/1987 | Poliak et al. |
| 4,836,805 | A | | 6/1989 | Poliak et al. |
| 5,470,183 | A | | 11/1995 | Swick |
| 5,472,350 | A | * | 12/1995 | Mehta ..... 439/107 |
| 5,658,108 | A | | 8/1997 | Swick |
| 5,692,930 | A | | 12/1997 | Garver et al. |
| 5,934,948 | A | * | 8/1999 | Hiramatsu et al. ..... 439/781 |
| 6,082,942 | A | | 7/2000 | Swick |
| 6,174,177 | B1 | | 1/2001 | Auclair |
| 6,263,922 | B1 | | 7/2001 | Kerner et al. |
| 6,293,812 | B1 | | 9/2001 | Ewer et al. |
| 6,743,029 | B1 | | 6/2004 | Greene et al. |
| 6,814,629 | B1 | | 11/2004 | Donfrancesco et al. |
| 6,861,189 | B1 | | 3/2005 | Greene et al. |

(Continued)

FOREIGN PATENT DOCUMENTS

DE 4033074 A1 5/1991

OTHER PUBLICATIONS

ISR and Written Opinion dated Mar. 21, 2011 for PCT/US2010/001612.

(Continued)

*Primary Examiner* — Vanessa Girardi
(74) *Attorney, Agent, or Firm* — Kacvinsky Daisak Bluni PLLC

(57) ABSTRACT

An electrical receptacle includes a detent for holding a terminal clamp in an open position. A terminal assembly having a terminal clamp, a terminal plate, and a terminal fastener. The terminal fastener can move the terminal clamp toward the terminal plate. The terminal clamp includes a tab that fits in a tab pocket formed in a middle housing of the receptacle. The tab pocket includes a detent for retaining the tab adjacent to a first end of the tab pocket. With the tab in this position, the terminal assembly is in the open configuration so that a space is formed between the terminal clamp and the terminal plate. In the open configuration an electrical wire can be disposed between the clamp and plate. To clamp the wire, the fastener is rotated to move the clamp toward the plate, and the detent releases the tab under application of force.

19 Claims, 11 Drawing Sheets

(56) References Cited

U.S. PATENT DOCUMENTS

| | | | |
|---|---|---|---|
| 6,864,422 | B1 | 3/2005 | Dionne et al. |
| 6,877,996 | B1 | 4/2005 | Franks, Jr. |
| 6,878,876 | B2 | 4/2005 | Brant et al. |
| 7,175,485 | B1 | 2/2007 | Alderson et al. |
| 2004/0089465 | A1 | 5/2004 | Brant et al. |
| 2010/0003865 | A1 | 1/2010 | Alderson et al. |
| 2010/0304596 | A1 | 12/2010 | Ilkhanov |
| 2013/0122759 | A1 | 5/2013 | Kamor et al. |

OTHER PUBLICATIONS

IPRP dated Dec. 4, 2012 for PCT/US2010/001612.

* cited by examiner

RECEPTACLE WITH TERMINAL HOLD-OPEN DETENT

FIELD OF THE DISCLOSURE

The disclosure generally relates to an electrical receptacle, and more particularly to an electrical receptacle having at least one terminal clamp that includes a hold open feature to facilitate the connection of external wiring.

BACKGROUND OF THE DISCLOSURE

Electrical receptacles provide a convenient means of supplying electrical power to electrical devices or appliances. In particular, indoor and outdoor lighting, appliances, and the like, make use of an electrical distribution system through access of these electrical receptacles located in the interior and/or exterior walls of building structures, such as homes and commercial buildings.

Many such electrical receptacles have a line side, which is connectable to an electrical power supply, a load side which is connectable to one or more loads, and at least one conductive path between the line and load sides. Electrical connections to wires supplying electrical power or wires conducting electricity to one or more loads can be at the line side and load side connections.

Connections to such electrical receptacles are often achieved using a clamping arrangement in which a wire is inserted between a terminal clamp and a terminal plate, whereupon the terminal clamp is pressed down onto the wire to clamp the wire between the clamp and the plate. Often the clamping force is supplied by a screw.

While such clamping arrangements are effective, their use can be cumbersome. For example, often the electrical wire is wrapped around the screw to ensure good long-term engagement with the receptacle. This requires that the user hold the terminal clamp open with one hand, while wrapping the wire around the screw with the other hand. When a user is installing multiple receptacles in a building, for example, during a new construction, this increases the total amount of time required to complete the wiring process.

It would, therefore, be desirable to provide an electrical receptacle having a terminal clamp that is configured to be automatically retained in the open position so the installer needn't do so. Such a "hold open" feature should also not interfere with the clamping.

SUMMARY OF THE DISCLOSURE

An electrical receptacle is disclosed, including a housing having a top cover portion, a middle housing portion, and a back cover portion. The housing may include openings comprising at least one electrical socket. The receptacle may include a terminal assembly having a terminal clamp, a terminal plate, and a terminal fastener. The terminal fastener may be operable to move the terminal clamp toward the terminal plate. The terminal clamp may further include a tab portion, and the middle housing portion may include a tab pocket for receiving the tab portion of the terminal clamp. The tab pocket may further include a detent for retaining the tab portion adjacent to a first end of the tab pocket. As arranged, when the tab portion is positioned adjacent to the first end of the tab pocket the terminal assembly is in the open configuration such that a space is formed between the terminal clamp and the terminal plate.

An electrical receptacle is disclosed. The electrical receptacle can have a housing with a top cover portion, a middle housing portion, and a back cover portion. The receptacle may also include a terminal assembly engaged with the middle housing portion and the back cover portion. The terminal assembly may include a terminal clamp, a terminal plate, and a terminal fastener. The terminal fastener may be configured to press the terminal clamp toward the terminal plate. The terminal clamp may include a tab, and the middle housing portion may include a tab pocket for receiving the tab of the terminal clamp therein. The tab pocket may also include opposing ribs for retaining the tab adjacent to a first end of the tab pocket. As arranged, when the tab is positioned adjacent to the first end of the tab pocket the terminal assembly is in the open configuration such that the terminal clamp is positioned a first distance from the terminal plate.

A method for holding a terminal clamp of an electrical receptacle in an open configuration is disclosed. The method may include: maintaining a terminal assembly of an electrical receptacle in an open configuration using a detent; wherein the detent comprises a pair of opposing ribs disposed in a tab pocket, the tab pocket configured to receive a tab portion of a terminal clamp of the terminal assembly to thereby hold the terminal clamp a first distance away from an associated terminal plate.

BRIEF DESCRIPTION OF THE DRAWINGS

One or more aspects of the present disclosure are particularly pointed out and distinctly claimed as examples in the claims at the conclusion of the specification. The foregoing and other objects, features, and advantages of the present invention may be more readily understood by one skilled in the art with reference being had to the following detailed description of several embodiments thereof, taken in conjunction with the accompanying drawings wherein like elements are designated by identical reference numerals throughout the several views, and in which:

DETAILED DESCRIPTION

Figure 1:
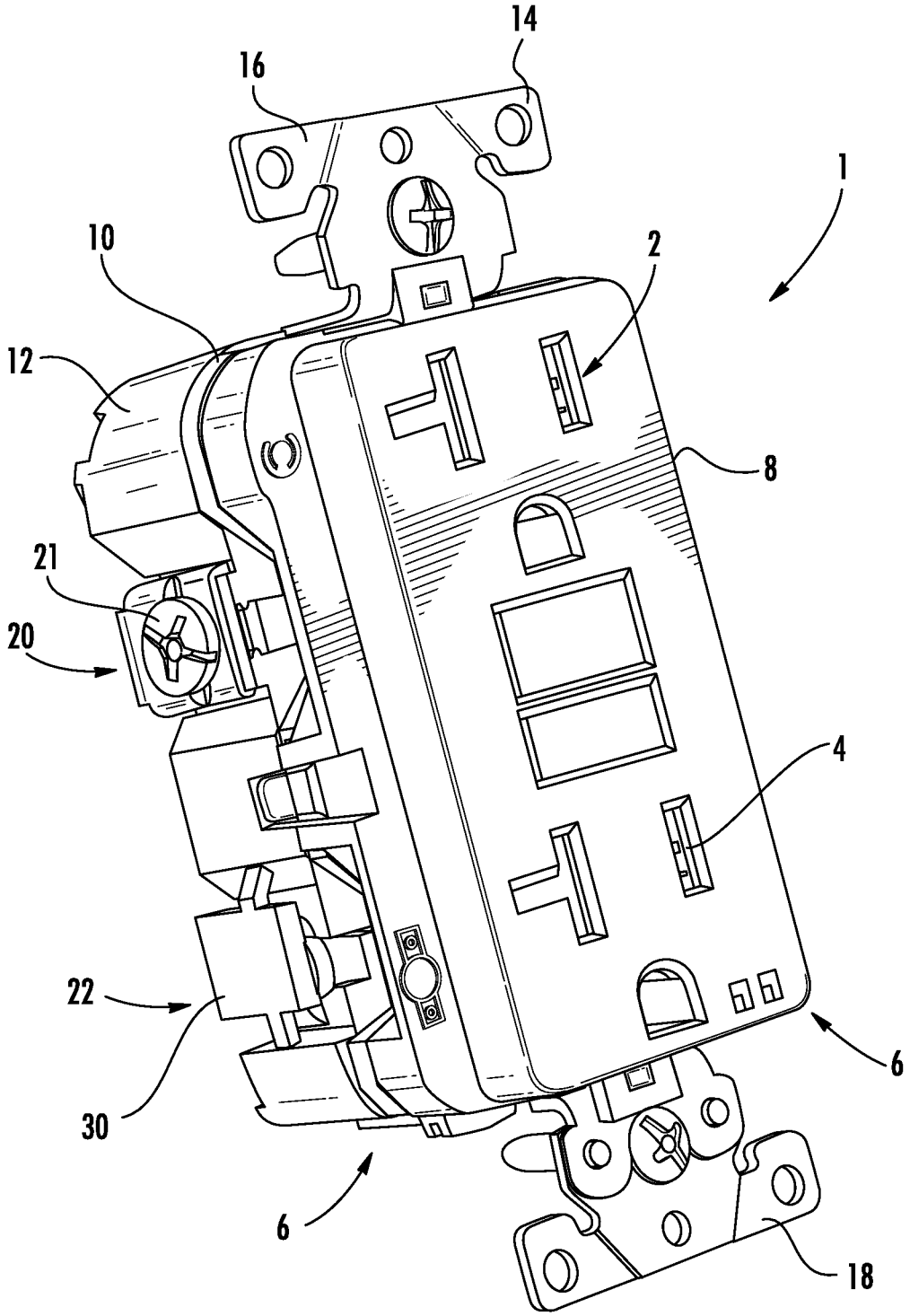
FIG. 1 is an isometric view of an exemplary embodiment of the disclosed electrical receptacle.
Figure 2:
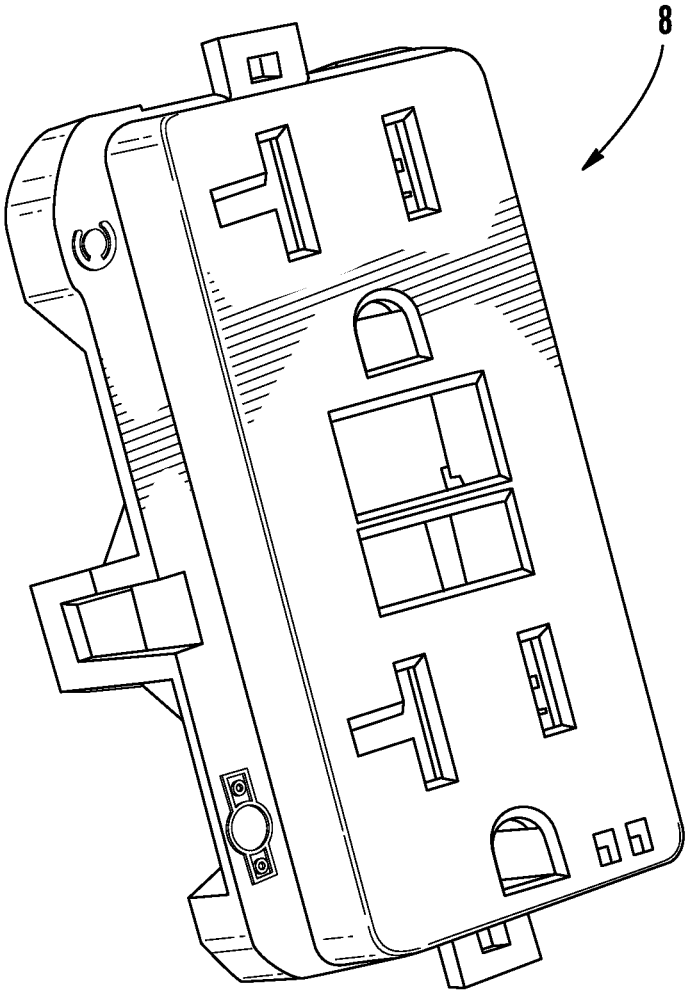
FIG. 2 is an isometric view of a top cover portion of the electrical receptacle of FIG. 1.
Figure 3:
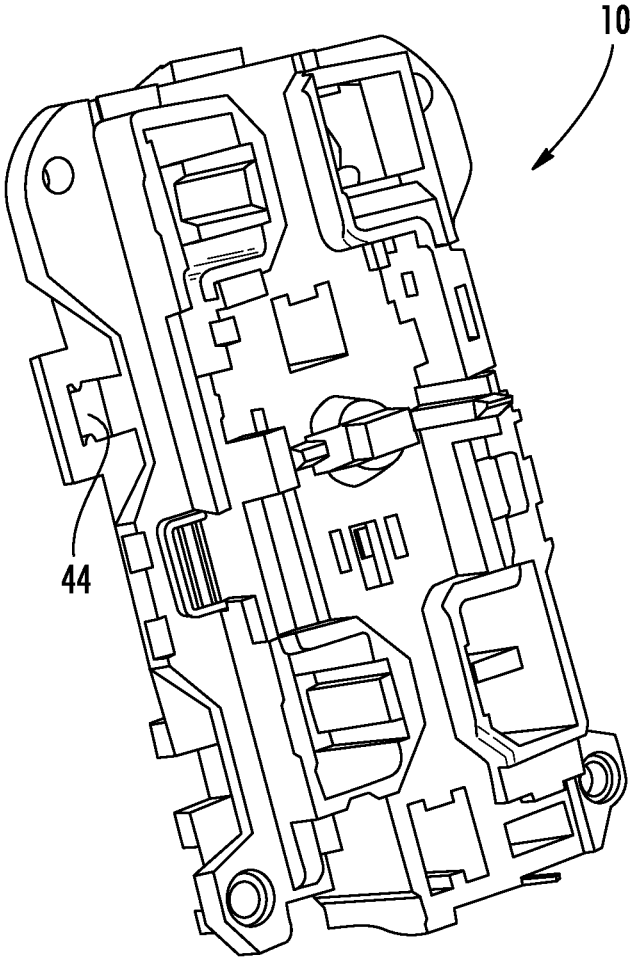
FIG. 3 is an isometric view of a middle housing portion of the electrical receptacle of FIG. 1.
Figure 4:
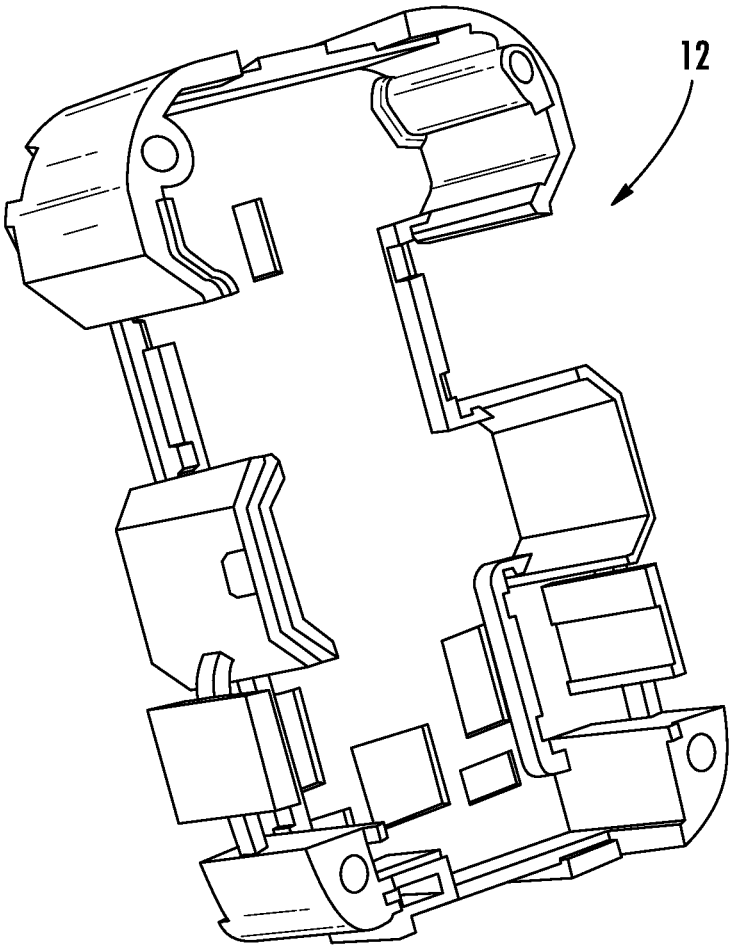
FIG. 4 is an isometric view of a back cover portion of the electrical receptacle of FIG. 1.

An electrical receptacle is disclosed which includes a feature for holding a terminal clamp open to allow easy connection of a wire used to supply electrical power to the receptacle. In one embodiment, the electrical receptacle includes a detent that engages the terminal clamp to hold the clamp away from an associated terminal plate, eliminating the need for a user to manually hold the clamp in the open configuration. In this manner, an electrical wire can easily be positioned between the open terminal clamp and the terminal plate. When the wire is in a desired position between the terminal clamp and the terminal plate, the detent may release the terminal clamp so that the clamp can press the wire against the terminal plate. In one embodiment, the detent comprises a pair of crushable ribs that disengage from the terminal clamp as the clamp is moved toward the terminal plate. As such, the clamp is held open only once, such that after the ribs have been crushed or otherwise deformed, the detent feature is no longer enabled.

Referring to FIGS. 1-4 the electrical receptacle 1 and components thereof are shown according to an exemplary embodiment. The receptacle 1 may be configured to be installed within or mounted to a wall, ceiling, floor and/or any other area or surface where it would be desirable to provide a connection point to a power source. According to the various alternative embodiments, receptacle 1 can include one or more electrical socket(s) 2, 4 each configured as a three-prong electrical receptacle and/or may be configured as a receptacle other than that of a duplex receptacle (e.g., a single receptacle, a triplex receptacle, etc.). Alternatively, electrical receptacle 1 may include one or more outlets of any suitable configuration.

The electrical socket(s) 2, 4 may be configured to be wired to a main power source such as 110 volts AC, as will be described in greater detail later. The receptacle 1 includes a housing 6 having a top cover portion 8, a middle housing portion 10 and a back cover portion 12. The top cover portion 8 may be removably coupled to the middle housing portion 10 and the back cover portion 12 using one or more suitable fasteners, snap-fit connections or the like. The portions 8, 10, 12 substantially enclose and protect the components of the receptacle 1, the function and arrangement of which will be known to those of ordinary skill and the art and as such will not be described in detail. For example, in one embodiment the receptacle 1 is a ground fault current interrupt (GFCI) receptacle. As such, the receptacle may have some or all of the components associated with such a GFCI receptacle, including, but not limited to, those disclosed in U.S. Pat. No. 7,463,124 to DiSalvo et al., and assigned to Leviton Manufacturing Company, Inc., the entirety of which patent is incorporated by reference herein.

The receptacle 1 may also include a mounting strap 14 disposed between the top cover portion 8 and the middle housing portion 10 to facilitate mounting the receptacle to an electrical box (e.g., wall box, etc.) using screws positioned through openings in first and second tabs 16, 18.

Figure 5:
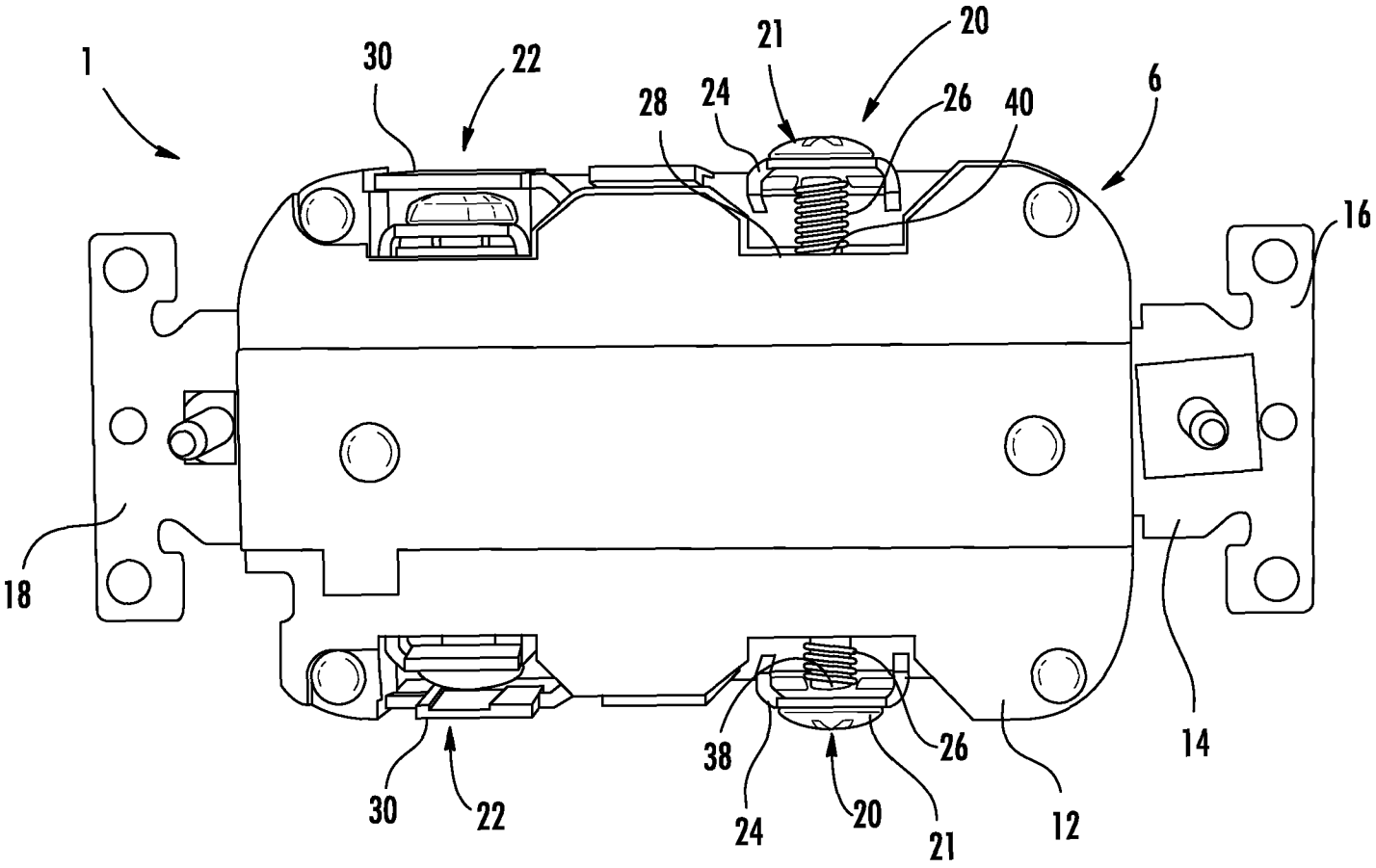
FIG. 5 is a bottom plan view of the receptacle of FIG. 1.

The receptacle 1 may include a plurality of terminals for connecting the receptacle to a source of electrical power, and also to enable the receptacle to deliver power to another receptacle in a circuit. FIG. 1 shows an exemplary line/phase terminal 20 and an exemplary load terminal 22 disposed on one side of the receptacle 1. As can be seen in FIG. 5, the receptacle may include a pair of line terminals and a pair of load terminals. As will generally be understood by one of ordinary skill in the art, the pair of line terminals includes one phase of hot terminal and one neutral terminal. Similarly, the pair of load terminals includes one phase of hot terminal and one neutral terminal.

Each of the line/phase terminals 20 may comprise a terminal assembly 21 including a terminal clamp 24, a terminal fastener 26, and a terminal plate 28. In use, an electrical wire (not shown) may be disposed between the terminal clamp 24 and the terminal plate 28, whereupon the fastener 26 may be employed to press the clamp toward the terminal plate, sandwiching the wire therebetween and completing an electrical connection between the wire and plate. Although not shown, one of ordinary skill in the art will understand the internal electrical couplings between the terminal plate 28 and the electrical socket(s) 2, 4. As will be appreciated, terminal clamps, terminal fasteners and terminal plates may also be employed for the load terminals 22.

In general, a line wire delivers power from the service panel (e.g., breaker panel or fuse box) to the line/phase terminal 20 of the receptacle 1. A black ("hot") line wire may couple to a first of the line/phase terminals 20 and a white line wire may couple to a second of the line/phase terminals. A black ("hot") load wire may couple to a first of the load terminals 22 and a white load wire may couple to a second of the load terminals. Thus arranged, the receptacle load terminals 22 may deliver power from the receptacle 1 to other loads downstream. In some embodiments the load terminals 22 can be blocked by removable cover 30 and/or sticker to prevent inadvertent connection of the line wire to the load terminals.

Figure 6:
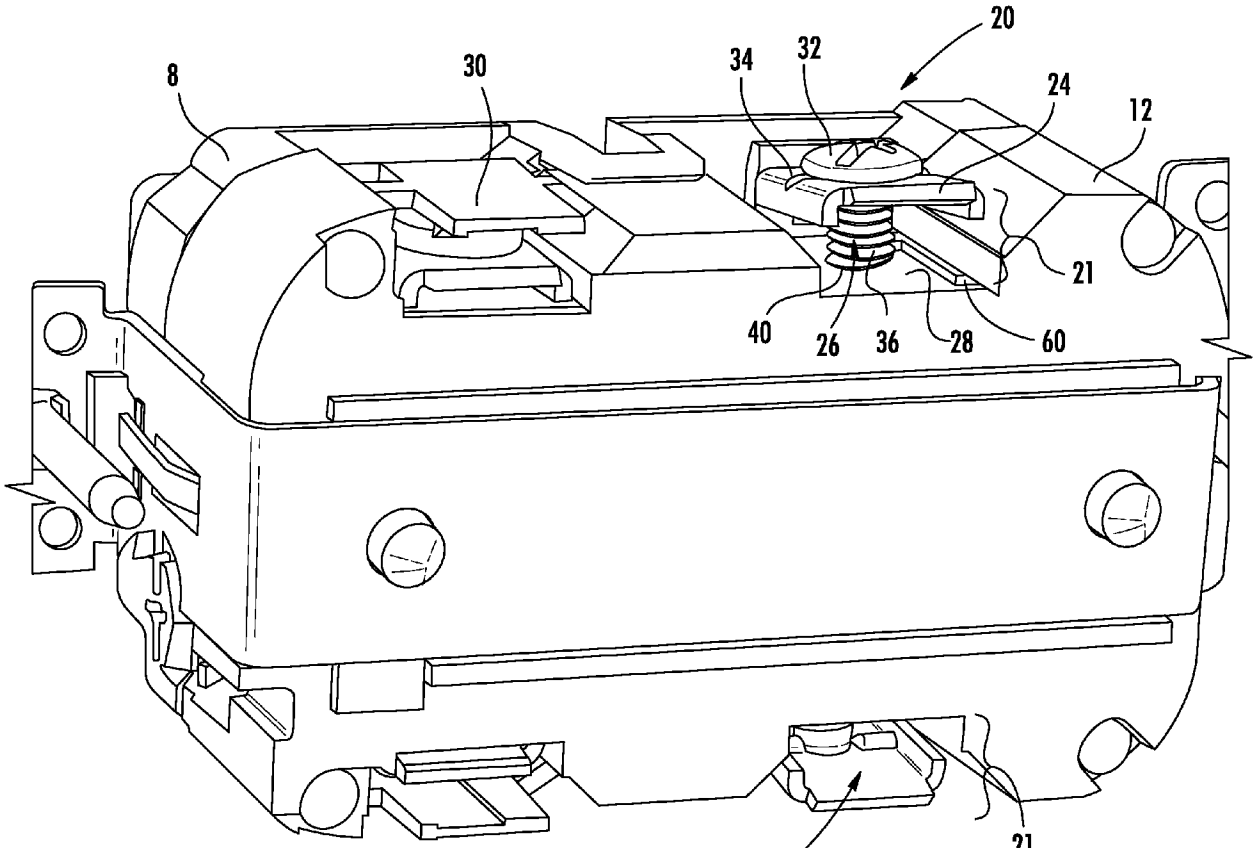
FIG. 6 is a partial isometric view of a terminal clamp portion of the receptacle of FIG. 1.

Referring now to FIG. 6, a line/phase terminal 20 may include the aforementioned terminal clamp 24, terminal fastener 26 and terminal plate 28. In the illustrated embodiment, the terminal fastener 26 is a screw having a head portion 32 disposed above an upper surface 34 of the terminal clamp. The body 36 of the terminal fastener may be received through an opening 38 (FIG. 5) in the terminal clamp 24 and a distal end of the fastener may be received in an opening 40 in the terminal plate 28 and back cover portion 12 of the housing 6. In one embodiment, the opening 40 in the back cover portion 12 is threaded so that as the terminal fastener 26 is rotated in a first direction, the head portion 32 of the terminal fastener 26 presses down on the upper surface 34 of the terminal clamp 24, forcing the terminal clamp 24 toward the housing and the terminal plate 28.

Figures 7A, 7B:
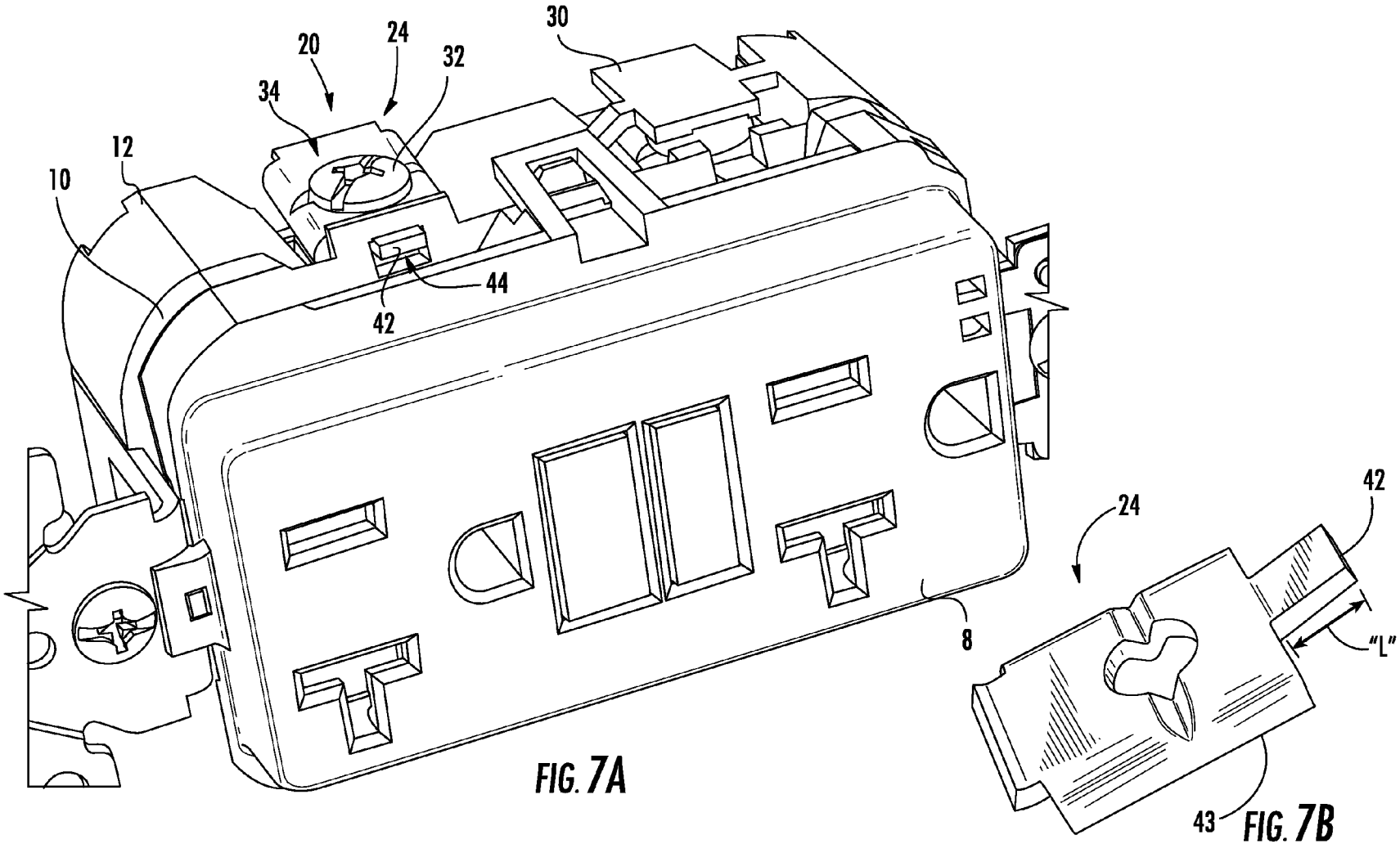
FIG. 7A is another partial isometric view of the terminal clamp portion of the receptacle of FIG. 1.
FIG. 7B is a top isometric view of the terminal clamp of FIG. 7A.
Figure 8:
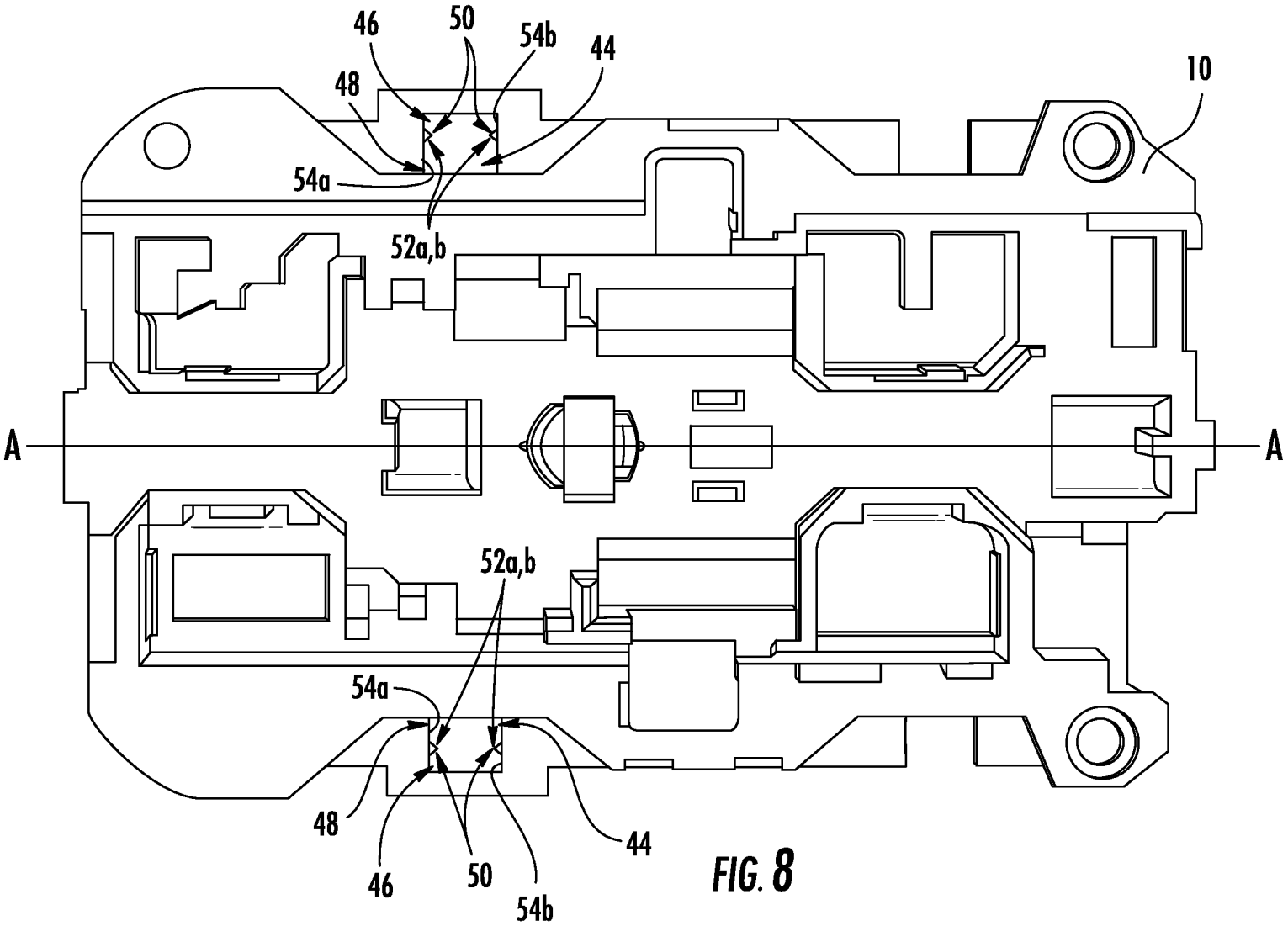
FIG. 8 is a plan view of the middle housing portion illustrating the disclosed detent arrangement.
Figure 10:
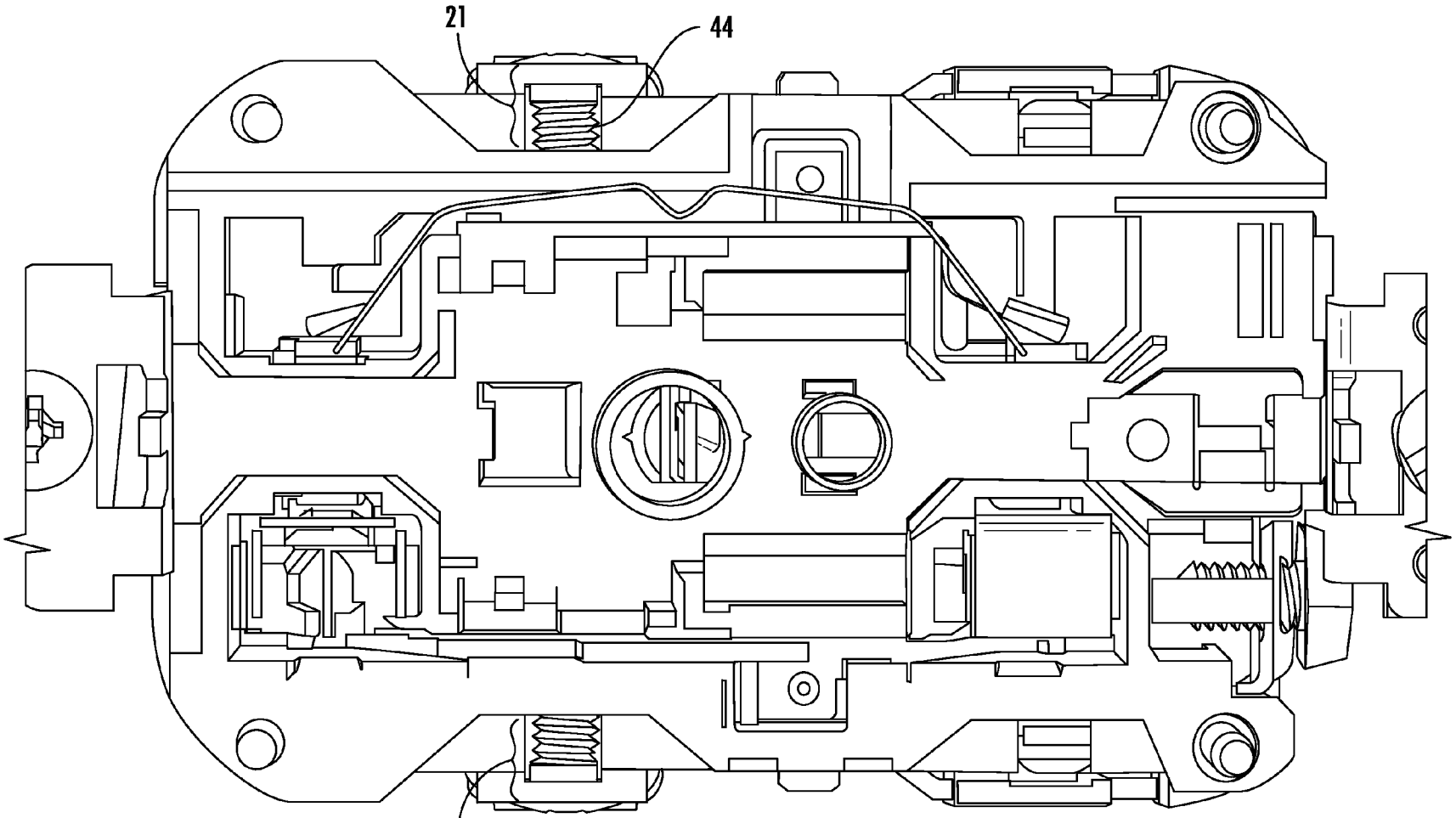
FIG. 10 is a top plan view of the receptacle of FIG. 1 with the top cover portion removed, showing the terminal clamp in the open configuration.
Figure 11:
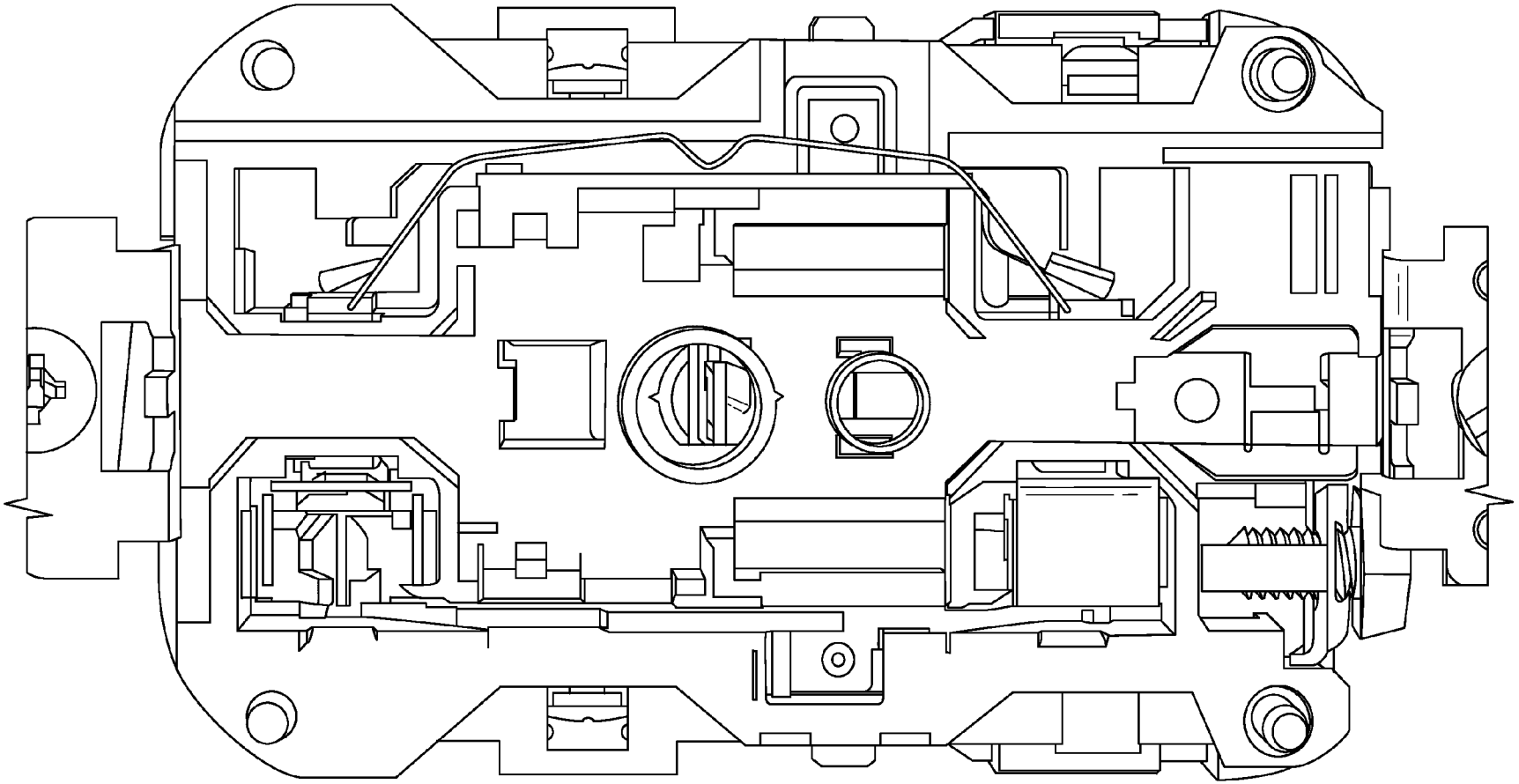
FIG. 11 is a top plan view of the receptacle of FIG. 1 with the top cover portion removed, showing the terminal clamp in the clamped configuration.

Referring to FIGS. 7A-7B, the terminal clamp 24 may include a tab portion 42 that extends outward from a side of the clamp. In the illustrated embodiment, the tab portion 42 extends toward the top cover portion 8, and is received within a tab pocket 44 formed in the middle housing portion 10. It will be appreciated that although the illustrated embodiment shows the tab portion 42 being received within a tab pocket 44 formed in the middle housing portion 10, the tab pocket could alternatively be formed in the top cover portion 8 of the housing 6 without departing from the scope of the disclosure. The tab pocket 44 has a rectangular shape with first and second ends 46, 48 (FIG. 8.) The first end 46 is disposed farther from a longitudinal centerline A-A of the receptacle 1 than the second end 48. The tab pocket 44 is oriented so that the tab portion 42 can travel within the pocket in the direction of travel of the head portion 32 as the terminal fastener 26 is tightened and loosened. Thus, when the terminal assembly 21 is in the "open" configuration shown in FIGS. 5-7A, the tab portion 42 is positioned in the first end 46 of the tab pocket 44. When the terminal assembly 21 is in the "clamped" configuration (shown in FIG. 11), the tab portion 42 is positioned closer to the second end 48 of the tab pocket. Thus, the tab is movable within the pocket between the "open" configuration of the terminal assembly (FIG. 10) and the "clamped" configuration of the terminal assembly (FIG. 11).

As shown in FIG. 7B, the tab portion 42 may extend laterally outward from the body portion 43 of the terminal clamp 24. Thus, the tab portion 42 may have a length "l" sufficient to enable the tab portion 42 to be received within the first end 46 of the tab pocket 44 when the receptacle 1 is assembled. In the illustrated embodiment, the tab portion 42 is shown as being rectangular, although it will be appreciated that the tab portion could be provided in a variety of other shapes. It will also be appreciated that although the tab pocket 44 is shown as being generally rectangular, other pocket shapes can also be used without departing from the scope of the disclosure.

As previously noted, it may be desirable to provisionally retain the terminal clamp 24 a distance above the terminal plate 28 to make it easier for the user to insert an electrical wire therebetween. Thus, as shown in FIG. 8, a detent 50 may be provided to prevent the terminal clamp 24 from dropping down onto the terminal plate 28 under the force of its own weight. Once an electrical wire is appropriately disposed between the terminal clamp and terminal plate, the detent 50 may release the terminal clamp 24 under force of the fastener 26, which can be rotated to press the clamp toward the plate to clamp the wire therebetween. In the illustrated embodiment, the detent 50 is formed on the middle housing portion 10 and comprises a pair of ribs 52*a, b* disposed on opposing sidewalls 54*a, b* of the tab pocket 44.

Figure 9B:
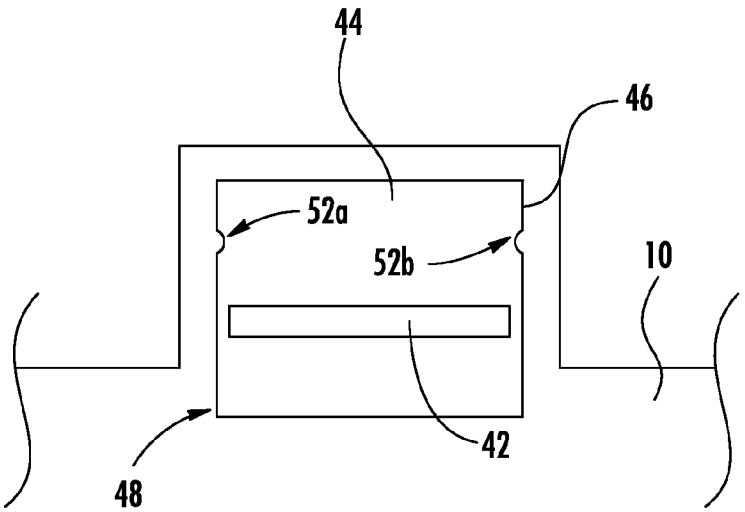
FIGS. 9A and 9B are detail views of the middle housing portion showing the interaction between the detent arrangement and an exemplary tab portion of a terminal clamp.
Figure 9A:
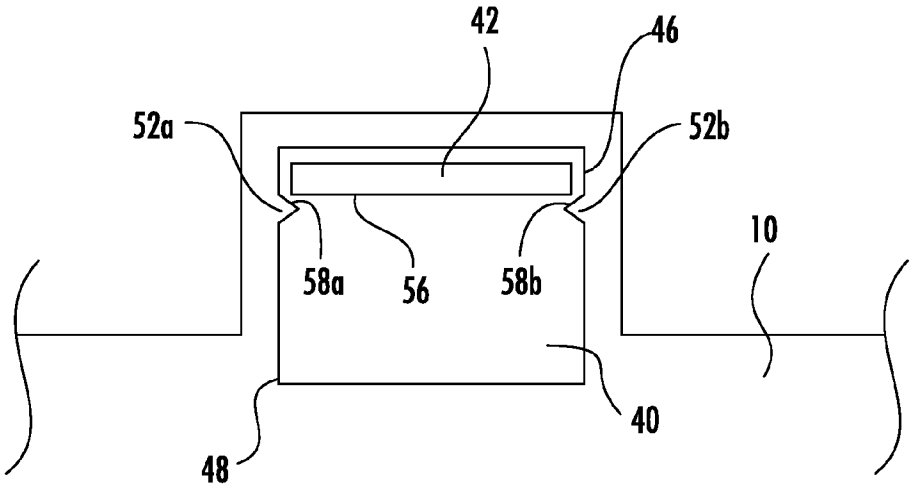

As can be seen in FIG. 9A, the pair of ribs 52*a, b* protrude into the tab pocket 44 so that a lower surface 56 of the tab portion 42 of the terminal clamp 24 engages an upper surface 58*a, b* of each rib to support the tab portion 42 (and terminal clamp 24) thereon. This position corresponds to FIG. 10, which shows the position of the tab when the terminal assembly 21 is in the "open" configuration. It will be appreciated that the ribs 52*a, b* may be arranged to be sufficiently strong to hold the tab portion 42 and terminal clamp 24 adjacent to the first end 46 of the tab pocket 44, which thereby holds the terminal clamp 24 up against, or next to, the head portion 32 of the terminal fastener 26. As can be seen most clearly in FIG. 6, this provides an open space 60 beneath the terminal clamp 24 which allows the user to loop an electrical wire around the body 36 of the terminal fastener 26 without having to manually hold the terminal clamp 24 in the open position.

Once the electrical wire appropriately positioned between the terminal clamp 24 and terminal plate 28, the user can engage the terminal fastener 26 with an appropriate driving tool to tighten the fastener, driving the terminal clamp 24 into engagement with the electrical wire to fix the wire in electrically connected engagement with the terminal plate 28. As the terminal clamp 24 is being driven toward the electrical wire and terminal plate 28, the tab portion 42 presses against the upper surfaces 58*a, b* of the ribs 52*a, b*, crushing, breaking or deforming the ribs 52*a, b* to an extent sufficient to allow the tab portion 42 to move from the first end 46 of the tab pocket 44 toward the second end 48 of the pocket. FIG. 9B shows the relative arrangement of the tab portion 42 in the tab pocket 44 once the tab portion 42 has passed by the ribs 52*a, b*. As can be seen, the ribs 52*a, b* have assumed a shorn or deformed condition owing to their interaction with the ribs 52*a, b*. This position corresponds to FIG. 11, which shows the position of the tab portion 42 when the terminal assembly 21 is in the "clamped" configuration.

As will be appreciated, once tab portion 42 moves from the first end 46 of the tab pocket 44 toward the second end 48 of the tab pocket, the ribs 52*a, b* will have been crushed, shorn or deformed and they no longer provide any resistance to the downward movement of the terminal clamp 24. Thus, with the disclosed detent 50, the terminal clamp 24 is held open only once. After the terminal assembly 21 is positioned in the "clamped" configuration (i.e., the terminal clamp 24 presses an electrical wire against the terminal plate 28) the detent feature is disabled.

In one embodiment, the middle housing portion 10 comprises a polymer material that is sufficiently strong to hold the tab portion 42 and terminal clamp 24 in place, and which is also easily deformed, crushed or broken when the terminal fastener 26 is actuated to move the terminal clamp 24 and tab portion 42 toward the terminal plate 28.

In the illustrated embodiment the ribs 52*a, b* have a triangular shape, but this is not critical, and it will be appreciated that the ribs can take other shapes such as rectangular, rounded, spherical, and the like. In addition, although the detent 50 is shown as including two opposed ribs 52*a, b*, it is contemplated that only a single rib may be used. Alternatively, three or more ribs can also be provided.

In the illustrated embodiment the ribs 52*a, b* are formed integral to the middle housing portion 10. For example, where the middle housing portion is an injection molded polymer piece, the ribs 52*a, b* may be formed during the injection molding process. It will be appreciated that this is not critical, and that the ribs 52*a, b* can be formed after the middle housing portion 10 has been formed. For example, discrete ribs 52*a, b* could be adhered or otherwise attached to the middle housing portion 10. In addition, although the detent 50 is shown as being associated with the middle housing portion 10, it could instead be provided as part of the top cover portion 8, the back cover portion 12, or other portion of the receptacle 1.

It will be appreciated that the detent 50 can be arranged in any of a variety of sizes, shapes and materials as long as it enables the tab portion 42 and terminal clamp 24 to be held in an open position for electrical wire installation, and releases the tab portion and terminal clamp to engage the wire with the terminal plate 28.

It is important to note that the terms used herein are intended to be broad terms and not terms of limitation. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Such joining may relate to a mechanical and/or electrical relationship between the two components.

It is also important to note that the construction and arrangement of the elements of the electrical receptacle as shown in the exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. Accordingly, all such modifications are intended to be included within the scope of the appended claims.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision additional modifications, features, and advantages within the scope and spirit of the claims appended hereto.

What is claimed is:

1. An electrical receptacle, comprising a housing including openings comprising at least one electrical socket;

a terminal assembly comprising a terminal clamp, a terminal plate, and a terminal fastener, the terminal fastener operable to move the terminal clamp toward the terminal plate, the terminal clamp further comprising a tab portion;

wherein the housing includes a tab pocket for receiving the tab portion of the terminal clamp therein, the tab pocket further including a detent for retaining the tab portion adjacent to a first end of the tab pocket;

wherein when the tab portion is positioned adjacent to the first end of the tab pocket the terminal assembly is in the open configuration such that a space is formed between the terminal clamp and the terminal plate; and wherein the detent comprises a pair of opposed ribs having respective upper surfaces engaged with a bottom surface of the tab portion when the terminal assembly is in the open configuration.

2. The electrical receptacle of claim 1, wherein the pair of opposed ribs are deformable such that when the terminal fastener is operated to move the terminal clamp toward the terminal plate the ribs release the tab portion.

3. An electrical receptacle, comprising:

a housing including openings comprising at least one electrical socket;

a terminal assembly comprising a terminal clamp, a terminal plate, and a terminal fastener, the terminal fastener operable to move the terminal clamp toward the terminal plate, the terminal clamp further comprising a tab portion;

wherein the housing includes a tab pocket for receiving the tab portion of the terminal clamp therein, the tab pocket further including a detent for retaining the tab portion adjacent to a first end of the tab pocket;

the detent comprising a pair of ribs disposed on opposing sidewalls of the tab pocket such that the pair of ribs protrude into the tab pocket to retain the tab portion adjacent to the first end of the tab pocket;

wherein when the tab portion is positioned adjacent to the first end of the tab pocket the terminal assembly is in the open configuration such that a space is formed between the terminal clamp and the terminal plate.

4. The electrical receptacle of claim 3, wherein the detent is integrally formed with the housing.

5. The electrical receptacle of claim 3, the terminal assembly further having a clamped configuration in which the terminal clamp is positioned adjacent to the terminal plate to clamp an electrical wire disposed therebetween.

6. The electrical receptacle of claim 5, wherein the tab pocket is rectangular and sized for guiding the tab portion between the open configuration and the clamped configuration of the terminal assembly.

7. The electrical receptacle of claim 5, the detent configured to release the tab portion when the terminal assembly is moved from the open configuration to the clamped configuration.

8. An electrical receptacle, comprising:

a housing having a top cover portion, a middle housing portion, and a back cover portion;

a terminal assembly engaged with the middle housing portion and the back cover portion, the terminal assembly comprising a terminal clamp, a terminal plate, and a terminal fastener, the terminal fastener for pressing the terminal clamp toward the terminal plate, the terminal clamp further including a tab;

wherein the middle housing portion includes a tab pocket for receiving the tab of the terminal clamp therein, the tab pocket further including opposing ribs for retaining the tab adjacent to a first end of the tab pocket;

wherein when the tab is positioned adjacent to the first end of the tab pocket the terminal assembly is in the open configuration such that the terminal clamp is positioned a first distance from the terminal plate;

wherein the terminal assembly further includes a clamped configuration in which the terminal clamp is positioned a second distance from the terminal plate, the second distance being less than the first distance;

wherein the opposing ribs are configured to release the tab when the terminal assembly is moved from the open configuration to the clamped configuration; and wherein the opposing ribs each has a triangular shape, the opposing ribs further having respective upper surfaces engaged with a bottom surface of the tab when the terminal assembly is in the open configuration.

9. An electrical receptacle, comprising:

a housing having a top cover portion, a middle housing portion, and a back cover portion;

a terminal assembly engaged with the middle housing portion and the back cover portion, the terminal assembly comprising a terminal clamp, a terminal plate, and a terminal fastener, the terminal fastener for pressing the terminal clamp toward the terminal plate, the terminal clamp further including a tab;

wherein the middle housing portion includes a tab pocket for receiving the tab of the terminal clamp therein, the tab pocket further including opposing ribs for retaining the tab adjacent to a first end of the tab pocket;

wherein when the tab is positioned adjacent to the first end of the tab pocket the terminal assembly is in the open configuration such that the terminal clamp is positioned a first distance from the terminal plate; and wherein the opposing ribs are deformable such that when the terminal fastener is operated to move the terminal clamp toward the terminal plate the opposing ribs deform and release the tab.

10. The electrical receptacle of claim 9, the terminal assembly further having a clamped configuration in which the terminal clamp is positioned a second distance from the terminal plate, the second distance being less than the first distance.

11. The electrical receptacle of claim 9, wherein the opposing ribs are integrally formed with the middle housing portion.

12. The electrical receptacle of claim 10, wherein the tab pocket is sized to guide the tab within the tab pocket as the terminal assembly is configured between the open and the clamped configurations.

13. The electrical receptacle of claim 10, the opposing ribs configured to release the tab when the terminal assembly is moved from the open configuration to the clamped configuration.

14. A method for operating a terminal clamp of an electrical receptacle, comprising:

maintaining a terminal assembly of an electrical receptacle in an open position using a detent, the detent comprises a pair of opposing ribs disposed on opposing sidewalls of a tab pocket, the tab pocket configured to receive a tab portion of a terminal clamp of the terminal assembly, the detent positioned to retain the tab portion of the terminal clamp adjacent to a first end of the tab pocket and a first distance away from an associated terminal plate; and moving the terminal clamp to a clamped position by applying a force to the terminal clamp to release the tab portion from the pair of opposing ribs, thereby allowing the tab portion to move within the tab pocket toward a second end of the tab pocket.

15. The method of claim 14, wherein when in the clamped position the terminal clamp is positioned a second distance away from the associated terminal plate, the second distance smaller than the first distance.

16. The method of claim 14, wherein moving the terminal clamp to the clamped position deforms, crushes or breaks the detent and releases the tab portion to move within the tab pocket.

17. The method of claim 16, wherein moving the terminal clamp comprises actuating a fastener, the fastener having a head engaged with a top surface of the terminal clamp.

18. The method of claim 14, wherein the pair of opposing ribs and the tab pocket are integrally formed in a middle housing portion of the electrical receptacle.

19. The method of claim 18, wherein the fastener and the terminal plate are engaged with a back cover portion of the electrical receptacle.

* * * * *